US009837189B2

(12) United States Patent
Gundel

(10) Patent No.: US 9,837,189 B2
(45) **Date of Patent: *Dec. 5, 2017**

(54) NESTED SHIELDED RIBBON CABLES

(71) Applicant: 3M INNOVATIVE PROPERTIES COMPANY, St. Paul, MN (US)

(72) Inventor: Douglas B. Gundel, Cedar Park, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/472,376

(22) Filed: Mar. 29, 2017

(65) Prior Publication Data

US 2017/0200533 A1 Jul. 13, 2017

Related U.S. Application Data

(63) Continuation of application No. 15/142,257, filed on Apr. 29, 2016, now Pat. No. 9,646,741, which is a continuation of application No. 14/111,793, filed as application No. PCT/US2012/040194 on May 31, 2012, now Pat. No. 9,355,756.

(60) Provisional application No. 61/494,055, filed on Jun. 7, 2011.

(51) Int. Cl.

| | |
|---|---|
| ***H01B 7/00*** | (2006.01) |
| ***H01B 11/20*** | (2006.01) |
| ***H01B 7/08*** | (2006.01) |
| ***H01B 11/18*** | (2006.01) |

(52) U.S. Cl.

CPC ..... *H01B 11/203* (2013.01); *H01B 7/0823* (2013.01); *H01B 7/0838* (2013.01); *H01B 7/0861* (2013.01); *H01B 11/1891* (2013.01); *H01B 11/1895* (2013.01)

(58) Field of Classification Search

CPC .. H01B 11/203; H01B 7/0823; H01B 7/0861; H01B 11/1891; H01B 11/1895; H01B 7/0838; H01B 7/08; H01B 7/0853

USPC ..... 174/110 R, 113 R, 117 R, 117 F, 117 FF, 174/36

See application file for complete search history.

(56) References Cited

U.S. PATENT DOCUMENTS 3,775,552 A * 11/1973 Schumacher ..... H01B 11/203 174/105 R
4,149,026 A * 4/1979 Fritz ..... H01B 7/08 174/113 R (Continued)

FOREIGN PATENT DOCUMENTS

| | | |
|---|---|---|
| EP | 0 366 046 | 5/1990 |
| JP | S57-153612 | 9/1982 |

(Continued)

OTHER PUBLICATIONS

PCT International Search Report from PCT/US2012/040194 dated Oct. 26, 2012, 4 pages.

(Continued)

*Primary Examiner* — William H Mayo, III
(74) *Attorney, Agent, or Firm* — Robert S. Moshrefzadeh

(57) ABSTRACT

The disclosure generally relates to nested shielded ribbon cables that form an electrical cable assembly. The electrical cable assembly includes features that can facilitate bending and movement of the cable.

9 Claims, 11 Drawing Sheets

(56) References Cited

U.S. PATENT DOCUMENTS 4,382,236 A * 5/1983 Suzuki ..... H01B 7/0838 156/52
4,481,379 A * 11/1984 Bolick, Jr. ..... H01B 7/0838 174/117 F
4,551,576 A 11/1985 Rich
4,780,157 A * 10/1988 Coon ..... H01B 7/08 156/443
4,836,357 A 6/1989 Focke
5,250,127 A * 10/1993 Hara ..... H01B 7/0861 156/247
5,446,239 A * 8/1995 Mizutani ..... H01B 7/0838 174/117 F
5,900,588 A * 5/1999 Springer ..... H01B 7/0861 174/117 F
7,807,927 B2 * 10/2010 Yeh ..... H01B 7/0838 174/110 R
2003/0102148 A1 * 6/2003 Ohara ..... B60R 16/0207 174/117 F
2003/0213610 A1 * 11/2003 Ide ..... H01B 7/0861 174/117 F
2006/0016615 A1 * 1/2006 Schilson ..... B23K 20/106 174/117 F
2007/0240898 A1 * 10/2007 Reichert ..... H01B 7/0838 174/117 F
2010/0300744 A1 12/2010 Romanko et al.

FOREIGN PATENT DOCUMENTS

| | | |
|---|---|---|
| JP | S59-57806 | 4/1984 |
| JP | H10-21755 | 1/1998 |
| JP | 2002-117731 | 4/2002 |
| JP | 2010-153121 | 7/2010 |
| WO | WO 2010/148157 | 12/2010 |

OTHER PUBLICATIONS

De Araujo, D.N. et al. "Full-Wave, TwinAx, Differential Cable Modeling", IEEE, 2008 Electronic Components and Technology Conference, pp. 1684-1689.

* cited by examiner

NESTED SHIELDED RIBBON CABLES

TECHNICAL FIELD

The present disclosure relates generally to nested flat electrical cables.

BACKGROUND

Electrical cables for transmission of electrical signals are well known. One common type of electrical cable is a coaxial cable. Coaxial cables generally include an electrically conductive wire surrounded by an insulator. The wire and insulator are surrounded by a shield, and the wire, insulator, and shield are surrounded by a jacket. Another common type of electrical cable is a shielded electrical cable comprising one or more insulated signal conductors surrounded by a shielding layer formed, for example, by a metal foil. To facilitate electrical connection of the shielding layer, a further un-insulated conductor is sometimes provided between the shielding layer and the insulation of the signal conductor or conductors. Both these common types of electrical cable normally require the use of specifically designed connectors for termination and are often not suitable for the use of mass-termination techniques, that is, the simultaneous connection of a plurality of conductors to individual contact elements, such as, for example, electrical contacts of an electrical connector or contact elements on a printed circuit board.

SUMMARY

The disclosure generally relates to nested shielded ribbon cables that form an electrical cable assembly. In one aspect, the present disclosure provides an electrical cable assembly that includes first and second electrical cables, each cable having a plurality of conductor sets extending along a length of the cable assembly and being spaced apart from each other along a width of the cable assembly. The first electrical cable includes at least first and second conductor sets each having at least two insulated conductors, each conductor set in the second electrical cable includes at least one insulated conductor. Each conductor set in the first and second electrical cables includes: first and second carrier films disposed on opposite first and second sides of the electrical cable, the first and second carrier films including cover portions and pinched portions arranged such that, in transverse cross section, the cover portions of the first and second carrier films in combination substantially surround each conductor set, and the pinched portions of the first and second carrier films in combination form pinched portions of the cable on each side of each conductor set. Each conductor set in the first and second electrical cable further includes an adhesive layer bonding the first and second carrier films in the pinched portions of the cable. The first and second electrical cables are arranged such that each conductor set of each cable is disposed within a pinched portion of the other cable, and at least one of the first and second electrical cables includes a slot in the pinched portion of the cable that extends through the cable, the slot having a slot width that is not greater than a width of the pinched portion and a slot length that is less than the length of the cable, the slot being sufficiently wide to allow an insulated conductor of a conductor set of the other cable that is disposed in the pinched portion to at least partially penetrate the slot.

In another aspect, the present disclosure provides an electrical cable assembly that includes a plurality of conductor sets extending along a length of the cable and being spaced apart from each other along a width of the cable, the plurality of the conductor sets having at least one conductor set that includes at least two insulated conductors, each conductor set having: first and second shielding films disposed on opposite first and second sides of the electrical cable, the first and second shielding films including cover portions and pinched portions arranged such that, in transverse cross section, the cover portions of the first and second carrier films in combination substantially surround each conductor set, and the pinched portions of the first and second films in combination form pinched portions of the cable on each side of each conductor set. Each conductor set further includes an adhesive layer bonding the first and second shielding films in the pinched portions of the cable. A maximum first separation of a pinched portion of the electrical cable from a plane intersecting each conductor is greater than a maximum second separation of the cover portions on either side of the pinched portion, from the plane intersecting each conductor.

In yet another aspect, the present disclosure provides an electrical cable assembly that includes a plurality of conductor sets extending along a length of the cable and being spaced apart from each other along a width of the cable, each conductor set having: at least one insulated conductor; and first and second carrier films disposed on opposite first and second sides of the electrical cable. The first and second carrier films include cover portions and pinched portions arranged such that, in transverse cross section, the cover portions of the first and second carrier films in combination substantially surround each conductor set, and the pinched portions of the first and second carrier films in combination form pinched portions of the cable on each side of each conductor set. Each conductor set further includes an adhesive layer bonding the first and second carrier films in the pinched portions of the cable; and a first carrier film affixed to each first carrier film and extending between adjacent conductor sets. The first carrier film has a smaller modulus than the first or second carrier films.

In yet another aspect, the present disclosure provides an electrical cable assembly that includes a first plurality of conductor sets extending along a length of the cable and being spaced apart from each other along a width of the cable, and a second plurality of drain wires extending along the length of the cable, each conductor set including: at least one insulated conductor and first and second shielding films disposed on opposite first and second sides of the electrical cable. The first and second shielding films include cover portions and pinched portions arranged such that, in transverse cross section, the cover portions of the first and second shielding films in combination substantially surround each conductor set, and the pinched portions of the first and second shielding films in combination form pinched portions of the cable on each side of each conductor set. Each conductor set further includes an adhesive layer bonding the first and second shielding films in the pinched portions of the cable. When the cable is laid flat, the insulated conductors define a first neutral plane, the cable without the second plurality of drain wires defines a second neutral plane that is not coincident with the first neutral plane, and the cable with the second plurality of drain wires defines a third neutral plane that is coincident with the first neutral plane.

The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings, where like reference numerals designate like elements, and wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1:
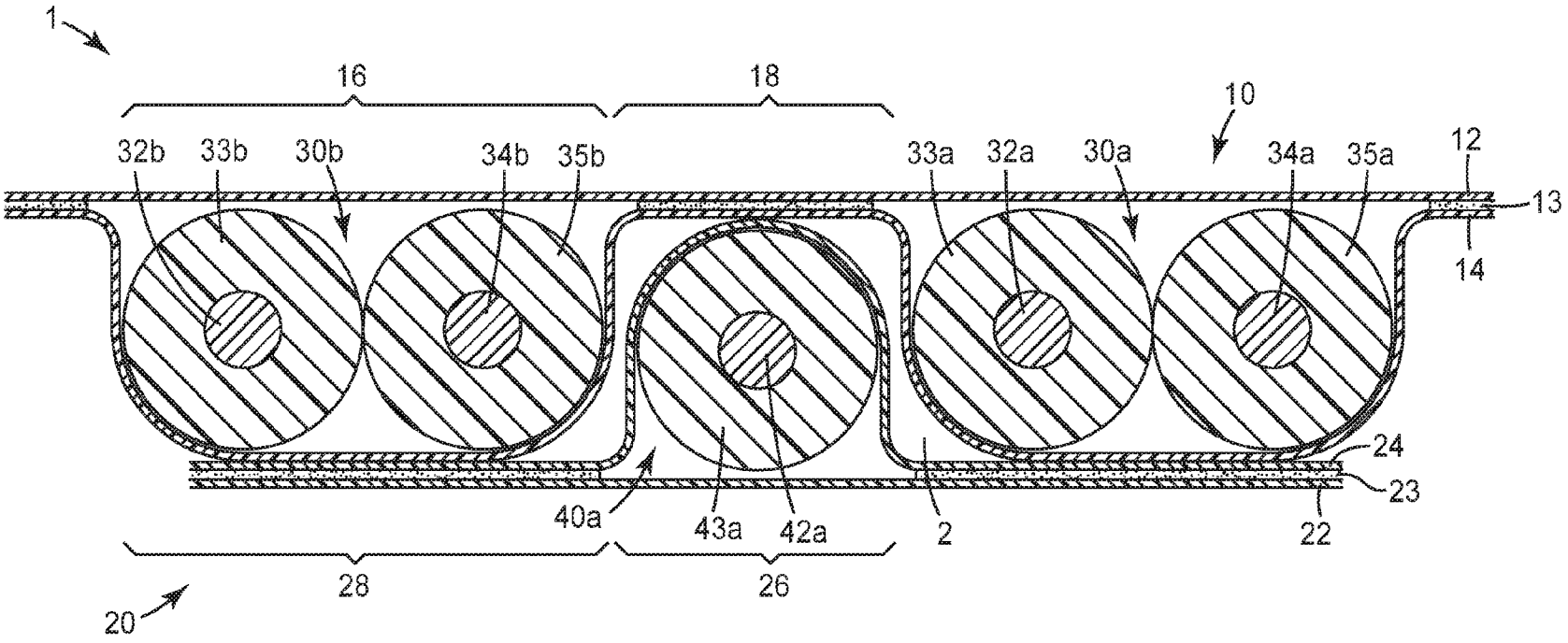
FIG. 1 shows a schematic cross-sectional view of a nested cable.

As the number and speed of interconnected devices increases, electrical cables that carry signals between such devices need to be smaller and capable of carrying higher speed signals without unacceptable interference or crosstalk. Shielding is used in some electrical cables to reduce interactions between signals carried by neighboring conductors such as, for example, electrical cables described in co-pending U.S. Patent Application No. 61/378,877 filed on Aug. 31, 2010, entitled "Connector Arrangements for Electrical Cables", the entire disclosure of which is included herein. The described cables have a generally flat configuration, and include conductor sets that extend along a length of the cable, as well as electrical shielding films disposed on opposite sides of the cable. Pinched portions of the shielding films between adjacent conductor sets help to electrically isolate the conductor sets from each other. Many of the cables also include drain (that is, drain and/or ground) wires that electrically connect to the shields, and extend along the length of the cable. The cable configurations described herein can help to simplify connections to the conductor sets and drain wires, reduce the size of the cable connection sites, and/or provide opportunities for mass termination of the cable.

The present application provides several enhancements to the generally flat electrical cables (for example, ribbon cables) described above. The present application generally provides electrical cable assemblies that are nested ribbon cable constructions, where at least two electrical cables are positioned such that a conductor set of one cable nestles into the space between adjacent conductor sets of another cable. The nested ribbon cable constructions include features that can facilitate bending and movement of the cable.

A set of two stacked ribbon cables can be a preferred way to mate with two stacked linear arrays at a termination location such as the two sides of a paddle card. In some cases, however, two ordinary ribbon cables can create a differential end position of the two cables as the nested cable is bent. In some cases, improved ribbon cables can be fabricated that enable the neutral planes of the two cables to be brought into closer alignment and thereby minimize this differential strain and simultaneously achieve a high effective density. This can create a thin cable that does not "piston" (that is, one cable attempting to move relative to the other), or generate large stresses at the termination point, or bulge when the stacked ribbon cable is bent.

The nesting of two or more ribbon cables can create a multi-channel flat cable. For many applications where a highly dense cable is preferred and also if termination of two sets of conductors are required on two opposite sides of a paddle card or two other arrays of termination points, two ribbon cables can be used very effectively. However, two separate ribbons can exhibit problems in bending (that can be compensated for if the two ribbons are cut to the right length each to compensate for the bend). Unless compensated prior to bending by forming different cable lengths, the inner cable (inside of the bend) requires less length than the outer cable to reach the same end point. If the cables are relatively deformable, they can absorb the strain through stretching, but electronic cables generally are not deformable without high forces or a resulting reduction in electrical properties. Generally, the inner cable deviates from the outer cable at some point in the bend to compensate for the difference in length. If this is not acceptable, or not possible due to the design, or if the cable is too stiff to compensate for the length change by bending, then a large "pistoning" force is generated at the end locations.

In one particular embodiment, the modification of one or both ribbons in the nested cable through slitting or creating slot-type windows can allow a portion of one cable to at least partially interpenetrate into the other cable. This at least partial interpenetration can result in a greater flexibility of the nested cable. In this nested cable structure, one or more of the ribbons can be modified to create a structure that more easily bends by allowing one ribbon to further penetrate into (or push through) the other ribbon on bending, as described elsewhere. The modification can be at one or more locations in a single nested cable, and can also be made to one or more of the ribbons comprising the nested set. In addition to providing more flexibility and reduction of "pistoning" (that is, differential lengths of components) on bending, the modifications can also be used to terminate the cable to the opposite side of a paddle card or PCB as the other end of the cable. In some cases, the cable can be terminated on both ends by routing the signal lines across one another. Not all channels of each ribbon need to be terminated to the same side of a given PCB, but the channels can instead be terminated to two different sides.

In one particular embodiment, enhanced nesting can be enabled through an additional feature in the cable that allows the conductors (that is, the signal wires) to reside in the same plane for both ribbons, such as a neutral axis bending plane. In one particular embodiment, enhanced nesting can be enabled by allowing the two planes of the signal channels to pass one another as the cables are put together. These embodiments provide a technique to readily attach one ribbon of the nested pair to the top side of a printed circuit board (PCB) or paddle card, and the other end to either the same or the opposite side of a similarly oriented PCB or paddle card. The modification of the two (or more) nested cables can form an additional mating feature that allows the cables to nest to a greater extent. This modification can allow the signal lines from each nested half to be more readily terminated on one or the other side of the PCB or paddle card. The nested designs are not limited to pair-wise grouping of insulated wires, but the groups can be one, two, three or more insulated wires. Additionally, drain and/or ground wires can be included in any desired location, to further adjust the position of the neutral axis bending plane.

In one particular embodiment, either one or both of a jacketing and a shielding layer can be placed around the nested cable construction. In this embodiment, a jacket, conductive shield (braid, metal layer, or other) and other dielectric layers can be used to create a jacketed cable. The jacket can be present to simply hold the two cables together or can be used to provide flammability, abrasion or crush resistance. The nested configuration provides a technique for the two cables to be bond together this way with limited pistoning as it is bent. The shield construction on this internal cable can provide excellent containment of any electromagnetic radiation from the cable. As a result, a simple jacket with no additional shielding can be used for applications where the cable extends outside of an enclosed metal box. In cases where a shield is needed, a conductive film (for example metal foil or metal/polymer laminate) shield can be wrapped around the cable or placed on one side or both sides of the cable set. In some cases, a metallic braid shield can be positioned over the nested cable structure. In some cases, particularly where a shield is used or a jacket only, conductive wires or non-conductive strength members can be placed along the cable length to provide strain relief. In some cases, a conductive wire can be used, and it can make electrical contact to the shield (if present) and can be terminated at one or both ends to the connector (chassis) ground.

FIG. 1 shows a schematic cross-sectional view of a nested cable assembly 1, according to one aspect of the disclosure. Nested cable assembly 1 includes a first electrical cable 10 and a second electrical cable 20 that are disposed in a nested configuration. First electrical cable 10 includes a first carrier film 12 and a second carrier film 14 disposed on opposite sides of the first electrical cable 10, forming a cover portion 16 around each of a first conductor set 30*a* and a second conductor set 30*b*. First carrier film 12 and second carrier film 14 also form a pinched portion 18 between the first and second conductor sets 30*a*, 30*b*. In one particular embodiment, an adhesive 13 can be disposed between the first and second carrier film 12, 14, in the pinched portion 18. The adhesive 13 bonds the first and second carrier film 12, 14 together, and the adhesive 13 may or may not be present in the cover portion 16. It is to be understood that any desired number of conductor sets can be included in the first electrical cable 10, each conductor set spaced apart from an adjacent conductor set by the pinched portion 18.

Each of the first conductor set 30*a* and the second conductor set 30*b* includes a first conductor 32*a*, 32*b*, and a second conductor 34*a*, 34*b*, respectively. Further, each of the first conductors 32*a*, 32*b* and second conductors 34*a*, 34*b*, are surrounded by an insulator 33*a*, 35*a*, 33*b*, 35*b*, respectively. In one particular embodiment, each of the conductor sets include two insulated conductors as shown in FIG. 1; however, in some cases, any number of insulated conductors can be included in each conductor set, for example, 1, 2, 3, 4, or even 5 or more insulated conductors can be included in each conductor set. In some cases, un-insulated conductors (not shown) can be included in the conductor set, for example, grounding or drain wires can be disposed adjacent to the conductor set in several locations, as described elsewhere.

In a similar fashion, second electrical cable 20 also includes a first carrier film 22 and a second carrier film 24 disposed on opposite sides of the second electrical cable 20, forming a cover portion 26 around a third conductor set 40*a*. First carrier film 22 and second carrier film 24 also form a pinched portion 28 on either side of the third conductor set 40*a*. In one particular embodiment, an adhesive 23 can be disposed between the first and second carrier film 22, 24, in the pinched portion 28. The adhesive 23 bonds the first and second carrier film 22, 24 together, and the adhesive 23 may or may not be present in the cover portion 26. It is to be understood that any desired number of conductor sets can be included in the second electrical cable 20, each conductor set spaced apart from an adjacent conductor set by the pinched portion 28.

The third conductor set 40*a* includes a third conductor 42*a* surrounded by an insulator 43*a*. In one particular embodiment, the third conductor set includes one insulated conductor as shown in FIG. 1; however, in some cases, any number of insulated conductors can be included in the conductor set, for example, 1, 2, 3, 4, or even 5 or more insulated conductors can be included in the conductor set. In some cases, un-insulated conductors (not shown) can be included in the conductor set, for example, grounding or drain wires can be disposed adjacent to the conductor set in several locations, as described elsewhere.

The nested cable assembly 1 is formed by positioning the cover portions 16 of the first electrical cables 10 adjacent the pinched portion 28 of the second electrical cable 20, and the corresponding cover portions 26 of the second electrical cables 20 adjacent the pinched portion 18 of the first electrical cable 10, as shown in FIG. 1. In one particular embodiment (not shown), one or more insulated conductors or non-insulated conductors can also be disposed within nesting region 2 located between second carrier film 14 proximate cover portion 16 of first electrical cable 10 and second carrier film 24 proximate cover portion 26 of second electrical cable 20.

Although in the embodiment illustrated in FIG. 1, each conductor set has either one or two insulated conductors, in other embodiments, some or all of the conductor sets may include only one insulated conductor, or may include more than two insulated conductors. For example, an alternative shielded electrical cable similar in design to that of FIG. 1 may include one conductor set that has eight insulated conductors, or eight conductor sets each having only one insulated conductor. This flexibility in arrangements of conductor sets and insulated conductors allows the disclosed shielded electrical cables to be configured in ways that are suitable for a wide variety of intended applications. For example, the conductor sets and insulated conductors may be configured to form: a multiple twinaxial cable, that is, multiple conductor sets each having two insulated conductors; a multiple coaxial cable, that is, multiple conductor sets each having only one insulated conductor; or combinations thereof. In some embodiments, a conductor set may further include a conductive shield (not shown) disposed around the one or more insulated conductor, and an insulative jacket (not shown) disposed around the conductive shield.

The conductors and/or ground wires may comprise any suitable conductive material and may have a variety of cross sectional shapes and sizes. For example, in cross section, the conductors and/or ground or drain wires may be circular, oval, rectangular or any other shape. One or more conductors and/or ground or drain wires in a cable may have one shape and/or size that differs from other one or more conductors and/or ground wires in the cable. The conductors and/or ground or drain wires may be solid or stranded wires. All of the conductors and/or ground or drain wires in a cable may be stranded, all may be solid, or some may be stranded and some solid. Stranded conductors and/or ground or drain wires may take on different sizes and/or shapes. The connectors and/or ground or drain wires may be coated or plated with various metals and/or metallic materials, including gold, silver, tin, and/or other materials.

The material used to insulate the conductors of the conductor sets may be any suitable material that achieves the desired electrical properties of the cable. In some cases, the insulation used may be a foamed insulation which includes air to reduce the dielectric constant and the overall thickness of the cable. One or both of the shielding (carrier) films may include a conductive layer and a non-conductive polymeric layer. The shielding films may have a thickness in the range of 0.01 mm to 0.05 mm and the overall thickness of the cable may be less than 2 mm or less than 1 mm. In some cases, one or both of the carrier films may include multiple conductor layers separated by multiple non-conductive polymeric layers such as those described in, for example, U.S. Patent Application No. US2010/0300744 (Romanko et al.), the entire disclosure of which is included herein. The conductive layer may include any suitable conductive material, including but not limited to copper, silver, aluminum, gold, and alloys thereof. The non-conductive polymeric layer may include any suitable polymeric material, including but not limited to polyester, polyimide, polyamide-imide, polytetrafluoroethylene, polypropylene, polyethylene, polyphenylene sulfide, polyethylene naphthalate, polycarbonate, silicone rubber, ethylene propylene diene rubber, polyurethane, acrylates, silicones, natural rubber, epoxies, and synthetic rubber adhesive. The non-conductive polymeric layer may include one or more additives and/or fillers to provide properties suitable for the intended application. In another aspect, at least one of the shielding films may include a laminating adhesive layer disposed between the conductive layer and the non-conductive polymeric layer. For shielding films that have a conductive layer disposed on a non-conductive layer, or that otherwise have one major exterior surface that is electrically conductive and an opposite major exterior surface that is substantially non-conductive, the shielding film may be incorporated into the shielded cable in several different orientations as desired. In some cases, for example, the conductive surface may face the conductor sets of insulated wires and ground wires, and in some cases the non-conductive surface may face those components. In cases where two shielding films are used on opposite sides of the cable, the films may be oriented such that their conductive surfaces face each other and each face the conductor sets and ground wires, or they may be oriented such that their non-conductive surfaces face each other and each face the conductor sets and ground wires, or they may be oriented such that the conductive surface of one shielding film faces the conductor sets and ground wires, while the non-conductive surface of the other shielding film faces conductor sets and ground wires from the other side of the cable.

In some cases, at least one of the shielding films may include a stand-alone conductive film, such as a compliant or flexible metal foil. The construction of the shielding films may be selected based on a number of design parameters suitable for the intended application, such as, for example, flexibility, electrical performance, and configuration of the shielded electrical cable (such as, for example, presence and location of ground conductors). In some cases, the shielding films have an integrally formed construction. In some cases, the shielding films may have a thickness in the range of 0.01 mm to 0.05 mm. The shielding films desirably provide isolation, shielding, and precise spacing between the conductor sets, and allow for a more automated and lower cost cable manufacturing process. In addition, the shielding films prevent a phenomenon known as "signal suck-out" or resonance, whereby high signal attenuation occurs at a particular frequency range. This phenomenon typically occurs in conventional shielded electrical cables where a conductive shield is wrapped around a conductor set.

As discussed elsewhere herein, adhesive material may be used in the cable construction to bond one or two shielding films to one, some, or all of the conductor sets at cover regions of the cable, and/or adhesive material may be used to bond two shielding films together at pinched regions of the cable. A layer of adhesive material may be disposed on at least one shielding film, and in cases where two shielding films are used on opposite sides of the cable, a layer of adhesive material may be disposed on both shielding films. In the latter cases, the adhesive used on one shielding film is preferably the same as, but may if desired be different from, the adhesive used on the other shielding film. A given adhesive layer may include an electrically insulative adhesive, and may provide an insulative bond between two shielding films. Furthermore, a given adhesive layer may provide an insulative bond between at least one of shielding films and insulated conductors of one, some, or all of the conductor sets, and between at least one of shielding films and one, some, or all of the ground conductors (if any). Alternatively, a given adhesive layer may include an electrically conductive adhesive, and may provide a conductive bond between two shielding films. Furthermore, a given adhesive layer may provide a conductive bond between at least one of shielding films and one, some, or all of the ground conductors (if any). Suitable conductive adhesives include conductive particles to provide the flow of electrical current. The conductive particles can be any of the types of particles currently used, such as spheres, flakes, rods, cubes, amorphous, or other particle shapes. They may be solid or substantially solid particles such as carbon black, carbon fibers, nickel spheres, nickel coated copper spheres, metal-coated oxides, metal-coated polymer fibers, or other similar conductive particles. These conductive particles can be made from electrically insulating materials that are plated or coated with a conductive material such as silver, aluminum, nickel, or indium tin-oxide. The metal-coated insulating material can be substantially hollow particles such as hollow glass spheres, or may comprise solid materials such as glass beads or metal oxides. The conductive particles may be on the order of several tens of microns to nanometer sized materials such as carbon nanotubes. Suitable conductive adhesives may also include a conductive polymeric matrix.

When used in a given cable construction, an adhesive layer is preferably substantially conformable in shape relative to other elements of the cable, and conformable with regard to bending motions of the cable. In some cases, a given adhesive layer may be substantially continuous, for example, extending along substantially the entire length and width of a given major surface of a given shielding film. In some cases, the adhesive layer may include be substantially discontinuous. For example, the adhesive layer may be present only in some portions along the length or width of a given shielding film. A discontinuous adhesive layer may for example include a plurality of longitudinal adhesive stripes that are disposed, for example, between the pinched portions of the shielding films on both sides of each conductor set and between the shielding films beside the ground conductors (if any). A given adhesive material may be or include at least one of a pressure sensitive adhesive, a hot melt adhesive, a thermoset adhesive, and a curable adhesive. An adhesive layer may be configured to provide a bond between shielding films that is substantially stronger than a bond between one or more insulated conductor and the shielding films. This may be achieved, for example, by appropriate selection of the adhesive formulation. An advantage of this adhesive configuration is to allow the shielding films to be readily strippable from the insulation of insulated conductors. In other cases, an adhesive layer may be configured to provide a bond between shielding films and a bond between one or more insulated conductor and the shielding films that are substantially equally strong. An advantage of this adhesive configuration is that the insulated conductors are anchored between the shielding films. When a shielded electrical cable having this construction is bent, this allows for little relative movement and therefore reduces the likelihood of buckling of the shielding films. Suitable bond strengths may be chosen based on the intended application. In some cases, a conformable adhesive layer may be used that has a thickness of less than about 0.13 mm. In exemplary embodiments, the adhesive layer has a thickness of less than about 0.05 mm.

A given adhesive layer may conform to achieve desired mechanical and electrical performance characteristics of the shielded electrical cable. For example, the adhesive layer may conform to be thinner between the shielding films in areas between conductor sets, which increases at least the lateral flexibility of the shielded cable. This may allow the shielded cable to be placed more easily into a curvilinear outer jacket. In some cases, an adhesive layer may conform to be thicker in areas immediately adjacent the conductor sets and substantially conform to the conductor sets. This may increase the mechanical strength and enable forming a curvilinear shape of shielding films in these areas, which may increase the durability of the shielded cable, for example, during flexing of the cable. In addition, this may help to maintain the position and spacing of the insulated conductors relative to the shielding films along the length of the shielded cable, which may result in more uniform impedance and superior signal integrity of the shielded cable.

A given adhesive layer may conform to effectively be partially or completely removed between the shielding films in areas between conductor sets, for example, in pinched regions of the cable. As a result, the shielding films may electrically contact each other in these areas, which may increase the electrical performance of the cable. In some cases, an adhesive layer may conform to effectively be partially or completely removed between at least one of the shielding films and the ground conductors. As a result, the ground conductors may electrically contact at least one of shielding films in these areas, which may increase the electrical performance of the cable. Even in cases where a thin layer of adhesive remains between at least one of shielding films and a given ground conductor, asperities on the ground conductor may break through the thin adhesive layer to establish electrical contact as intended.

Figure 2A:
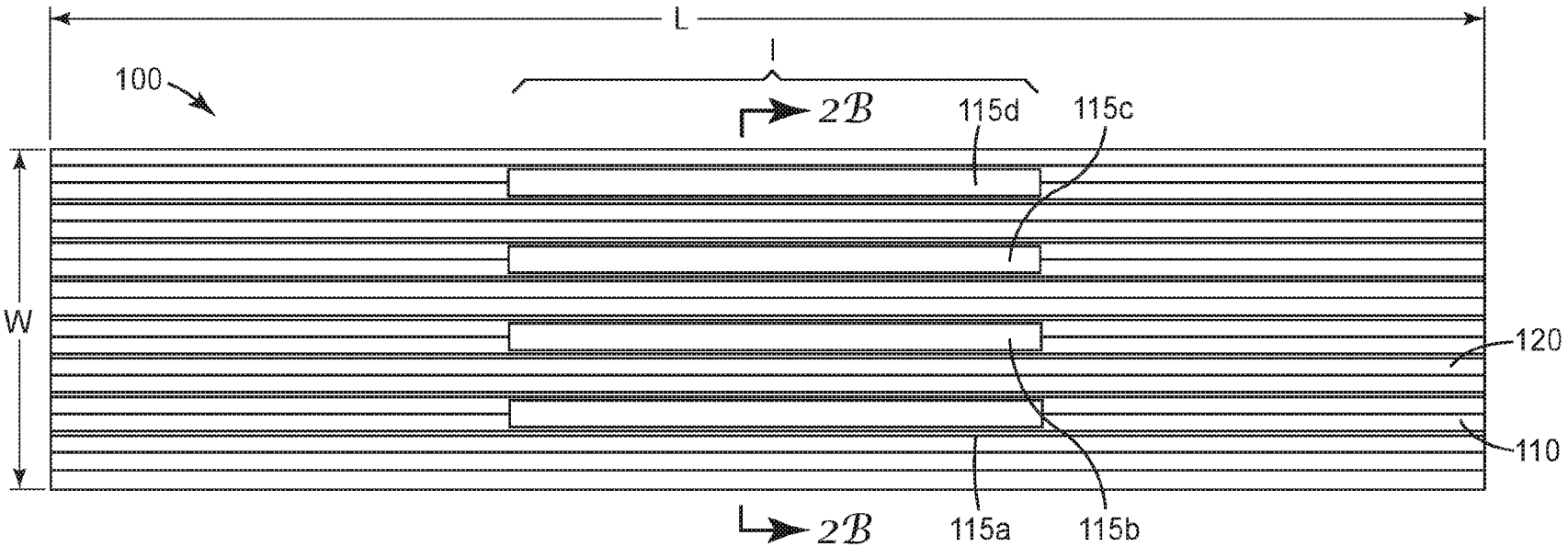
FIG. 2A shows a schematic top view of a nested cable.

FIG. 2A shows a schematic top view of a nested cable assembly 100, according to one aspect of the disclosure. Nested cable assembly 100 includes a cable width W and a cable length L along which a first electrical cable 110 and a second electrical cable 120 are nested together. First electrical cable 110 and second electrical cable 120 can be similar to first electrical cable 10 and second electrical cable 20 described in FIG. 1. Nested cable assembly 100 further includes a plurality of slots 115*a*-115*d* in the pinched portion of at least one of the first and second electrical cables, as described elsewhere. Each of the plurality of slots 115*a*-115*d* generally have a slot length "l" that is less than the cable length L, and can be disposed in more than one location of the nested cable assembly 100.

Figure 2B:
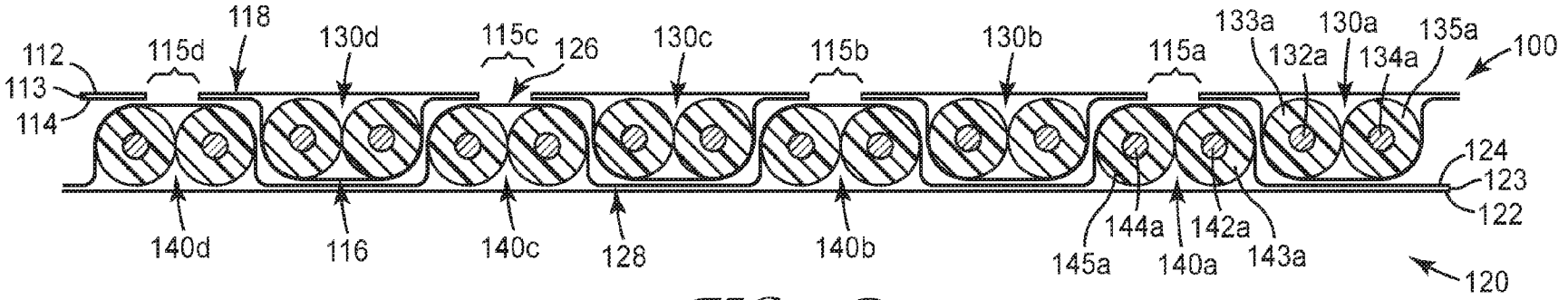
FIG. 2B shows a schematic cross-sectional view of a nested cable.

FIG. 2B shows a schematic cross-sectional view of the nested cable assembly 100 of FIG. 2A through section A-A', according to one aspect of the disclosure. Each of the elements 110-143*a* shown in FIG. 2B correspond to like-numbered elements 10-43*a* shown in FIG. 1, which have been described previously, and the contemplated materials and properties of materials likewise correspond. For example, first electrical cable 110 in FIG. 2B corresponds to first electrical cable 10 in FIG. 1, and so on.

Nested cable assembly 100 includes a first electrical cable 110 and a second electrical cable 120 that are disposed in a nested orientation. First electrical cable 110 includes a first carrier film 112 and a second carrier film 114 disposed on opposite sides of the first electrical cable 110, forming a cover portion 116 around each of a first conductor set 130*a*, a second conductor set 130*b*, a third conductor set 130*c*, and a fourth conductor set 130*d*. First carrier film 112 and second carrier film 114 also form a pinched portion 118 between each adjacent first through fourth conductor sets 130*a*-130*d*, extending such that each of the first through fourth conductor sets 130*a*-130*d* include a pinched portion 118 surrounding each cover portion 116. In one particular embodiment, an adhesive 113 can be disposed between the first and second carrier film 112, 114, in the pinched portion 118, as described elsewhere. The adhesive 113 bonds the first and second carrier film 112, 114 together, and the adhesive 113 may or may not be present in the cover portion 116. As shown in FIG. 2B, four conductor sets are disposed in first electrical cable 110; however, it is to be understood that any desired number of conductor sets can be included in the first electrical cable 110, each conductor set spaced apart from an adjacent conductor set by the pinched portion 118, as described elsewhere.

Each of the first through fourth conductor sets 130*a*-130*d* includes conductors and insulators; however, for the sake of brevity, only the components associated with the first conductor set 130*a* will be described. It is to be understood that similar components are included in the first through fourth conductor sets 130*a*-130*d*. The first conductor set 130*a* includes a first conductor 132*a* and a second conductor 134*a*. Further, each of the first conductors 132*a* and second conductors 134*a* are surrounded by an insulator 133*a*, 135*a*, respectively. In one particular embodiment, each of the conductor sets include two insulated conductors as shown in FIG. 2B; however, in some cases, any number of insulated conductors can be included in each conductor sets, for example, 1, 2, 3, 4, or even 5 or more insulated conductors can be included in each conductor set. In some cases, un-insulated conductors (not shown) can be included in the conductor set, for example, grounding or drain wires can be disposed adjacent to the conductor set in several locations, as described elsewhere.

In a similar fashion, second electrical cable 120 includes a first carrier film 122 and a second carrier film 124 disposed on opposite sides of the second electrical cable 120, forming a cover portion 126 around each of a first conductor set 140*a*, a second conductor set 140*b*, a third conductor set

140*c*, and a fourth conductor set 140*d*. First carrier film 122 and second carrier film 124 also form a pinched portion 128 between each adjacent first through fourth conductor sets 140*a*-140*d*, extending such that each of the first through fourth conductor sets 140*a*-140*d* include a pinched portion 128 surrounding each cover portion 126. In one particular embodiment, an adhesive 123 can be disposed between the first and second carrier film 122, 124, in the pinched portion 128, as described elsewhere. The adhesive 123 bonds the first and second carrier film 122, 124 together, and the adhesive 123 may or may not be present in the cover portion 126. As shown in FIG. 2B, four conductor sets are disposed in second electrical cable 120; however, it is to be understood that any desired number of conductor sets can be included in the second electrical cable 120, each conductor set spaced apart from an adjacent conductor set by the pinched portion 128, as described elsewhere.

Each of the first through fourth conductor sets 140*a*-140*d* includes conductors and insulators; however, for the sake of brevity, only the components associated with the first conductor set 140*a* will be described. It is to be understood that similar components are included in the first through fourth conductor sets 140*a*-140*d*. The first conductor set 140*a* includes a first conductor 142*a* and a second conductor 144*a*. Further, each of the first conductors 142*a* and second conductors 144*a* are surrounded by an insulator 143*a*, 145*a*, respectively. In one particular embodiment, each of the conductor sets include two insulated conductors as shown in FIG. 2B; however, in some cases, any number of insulated conductors can be included in each conductor sets, for example, 1, 2, 3, 4, or even 5 or more insulated conductors can be included in each conductor set. In some cases, un-insulated conductors (not shown) can be included in the conductor set, for example, grounding or drain wires can be disposed adjacent to the conductor set in several locations, as described elsewhere.

The nested cable assembly 100 is formed by positioning the cover portions 116 of the first electrical cable 110 adjacent the pinched portion 128 of the second electrical cable 120, and the corresponding cover portions 126 of the second electrical cables 120 adjacent the pinched portion 118 of the first electrical cable 110, as shown in FIG. 2B. Nested cable assembly 100 further includes a plurality of slots 115*a*-115*d* in the pinched portion 118 of the first electrical cable 110. Each of the plurality of slots 115*a*-115*d* extend over the pinched portion 118 such that first and second carrier films 112, 114 remain bonded to each other with adhesive 113. In some cases, the plurality of slots 115*a*-115*d* is disposed within each pinched portion 118; however, one or more of the pinched portions 118 may not contain a slot. In some cases, the plurality of slots 115*a*-115*d* may be positioned adjacent each other across the width W of the nested cable assembly 100 as shown in FIG. 2B; however, one or more of the slots may instead be disposed at different positions along the length L of the nested cable assembly 100. In some cases, the plurality of slots 115*a*-115*d* may be disposed at either or both ends of the nested cable assembly 100. Each of the plurality of slots 115*a*-115*d* have a sufficient width to permit the cover portion 126 of the second electrical cable 120 to at least partially penetrate the slot.

Figure 2C:
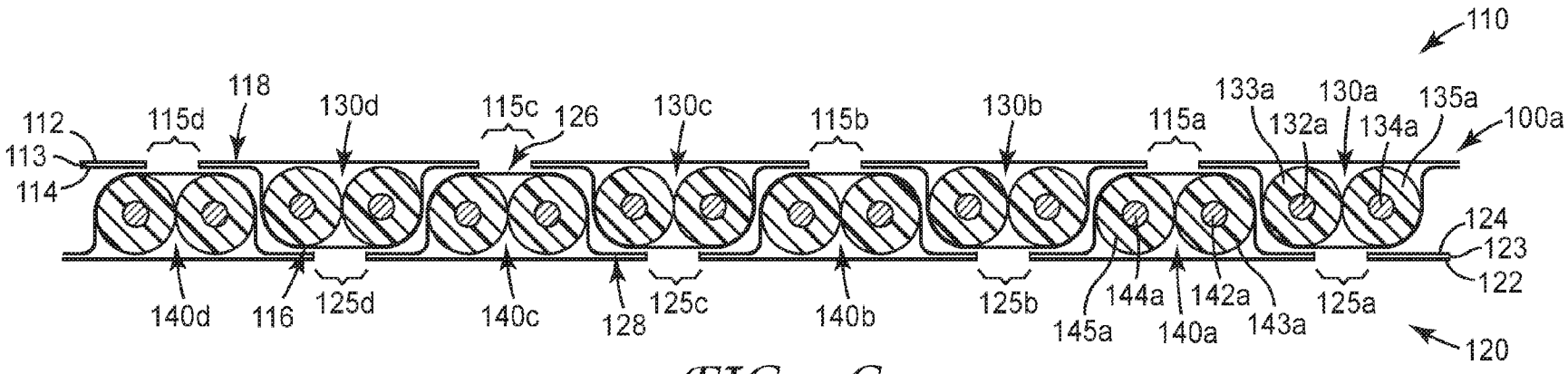
FIG. 2C shows a schematic cross-sectional view of a nested cable.

FIG. 2C shows a schematic cross-sectional view of the nested cable assembly 100 of FIG. 2A through section A-A', according to one aspect of the disclosure. In FIG. 2C, the nested cable assembly 100 of FIG. 2A is designated as a nested cable assembly 100*a* that includes a second plurality of slots, as described below. Each of the elements 110-143*a* shown in FIG. 2C correspond to like-numbered elements 110-143*a* shown in FIG. 2B, which have been described previously, and the contemplated materials and properties of materials likewise correspond. For example, first electrical cable 110 in FIG. 2B corresponds to first electrical cable 110 in FIG. 2C, and so on.

The nested cable assembly 100*a* is formed by positioning the cover portions 116 of the first electrical cables 110 adjacent the pinched portion 128 of the second electrical cable 120, and the corresponding cover portions 126 of the second electrical cables 120 adjacent the pinched portion 118 of the first electrical cable 110, as shown in FIG. 2B. Nested cable assembly 100*a* further includes a plurality of slots 115*a*-115*d* in the pinched portion 118 of the first electrical cable 110. Each of the plurality of slots 115*a*-115*d* extend over the pinched portion 118 such that first and second carrier films 112, 114 remain bonded to each other with adhesive 113. In some cases, the plurality of slots 115*a*-115*d* is disposed within each pinched portion 118; however, one or more of the pinched portions 118 may not contain a slot. In some cases, the plurality of slots 115*a*-115*d* may be positioned adjacent each other across the width W of the nested cable assembly 100 as shown in FIG. 2B; however, one or more of the slots may instead be disposed at different positions along the length L of the nested cable assembly 100. In some cases, the plurality of slots 115*a*-115*d* may be disposed at either or both ends of the nested cable assembly 100. Each of the plurality of slots 115*a*-115*d* have a sufficient width to permit the cover portion 126 of the second electrical cable 120 to at least partially penetrate the slot.

Nested cable assembly 100*a* still further includes a second plurality of slots 125*a*-125*d* in the pinched portion 128 of the second electrical cable 120. Each of the second plurality of slots 125*a*-125*d* extend over the pinched portion 128 such that first and second carrier films 122, 124 remain bonded to each other with adhesive 123. In some cases, the second plurality of slots 125*a*-125*d* is disposed within each pinched portion 128; however, one or more of the pinched portions 128 may not contain a slot. In some cases, the second plurality of slots 125*a*-125*d* may be positioned adjacent each other across the width W of the nested cable assembly 100*a* as shown in FIG. 2C; however, one or more of the slots may instead be disposed at different positions along the length L of the nested cable assembly 100*a*. In some cases, the second plurality of slots 125*a*-125*d* may be disposed at either or both ends of the nested cable assembly 100*a*. In some cases, the plurality of slots 115*a*-115*d* and the second plurality of slots 125*a*-125*d* can be disposed in the same region of nested cable assembly 100*a*; however, they may also be disposed in different regions of the nested cable assembly 100*a*. Each of the plurality of slots 125*a*-125*d* have a sufficient width to permit the cover portion 116 of the first electrical cable 110 to at least partially penetrate the slot.

Figure 3:
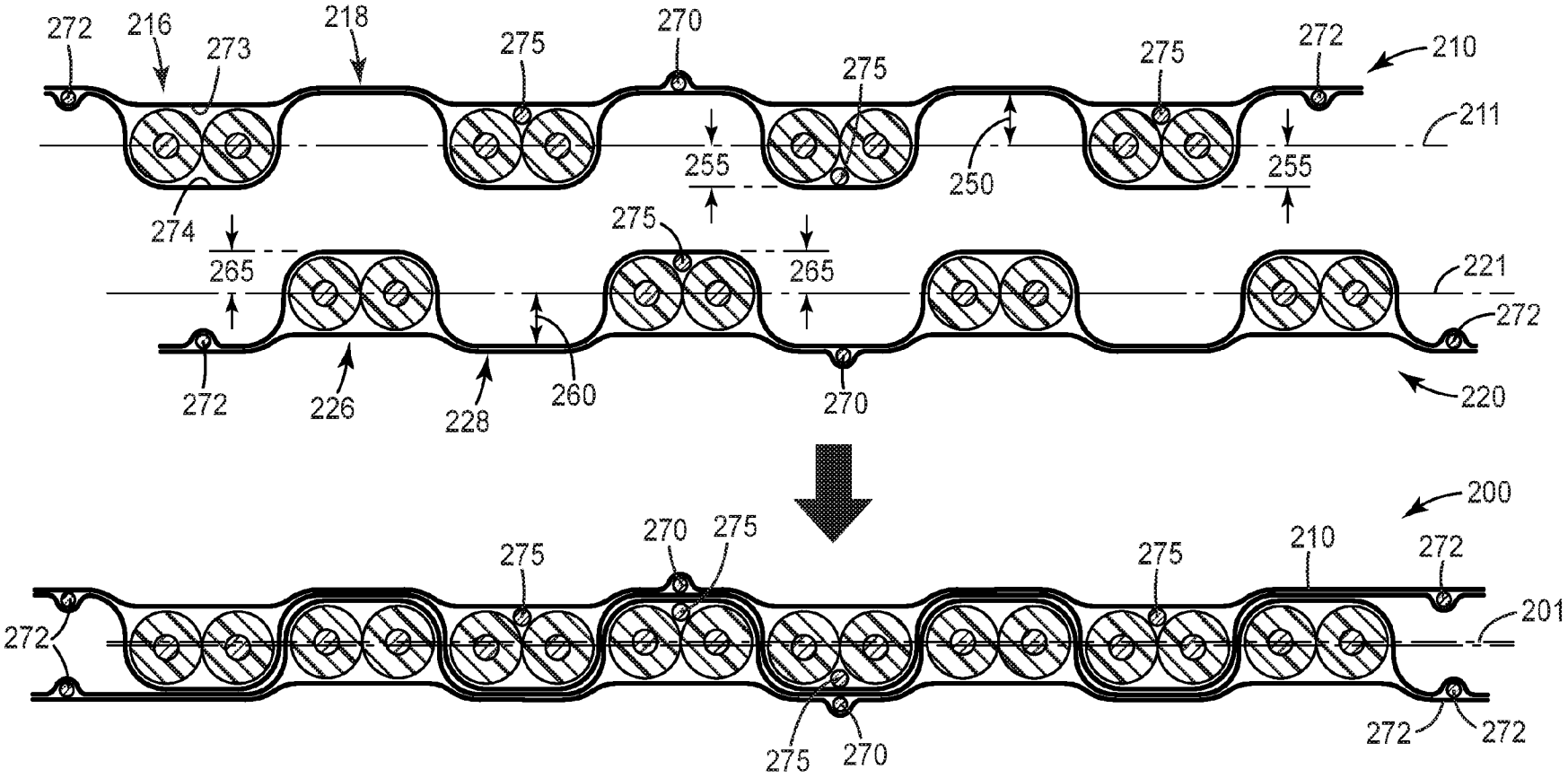
FIG. 3 shows a cross-sectional assembly schematic of a nested cable.

FIG. 3 shows a cross-sectional assembly schematic of a nested cable assembly 200, according to one aspect of the disclosure. The nested cable assembly 200 more closely aligns the neutral axis of each of the nested electrical cables with each other, thereby reducing the tendency for the cables to separate or piston relative to each other upon the application of any external stresses. Each of the elements 210-243*a* shown in FIG. 3 correspond to like-numbered elements 110-143*a* shown in FIGS. 2A-2C, which have been described previously, and the contemplated materials and properties of materials likewise correspond. For example, first electrical cable 210 in FIG. 3 corresponds to first electrical cable 110 in FIG. 2A, and so on.

Nested cable assembly 200 includes first electrical cable 210 and second electrical cable 220, each having cover portions 216, 226 and pinched portions 218, 228, respectively. Each of the pinched portions 218 of first electrical cable 210 are disposed at a first maximum pinched separation 250 from a first neutral axis 211, and each of the cover portions 216 are disposed at a first maximum cover separation 255 from the first neutral axis 211. In a like manner, each of the pinched portions 228 of second electrical cable 220 are disposed at a second maximum pinched separation 260 from a second neutral axis 221, and each of the cover portions 226 are disposed at a second maximum cover separation 265 from the second neutral axis 221. The first and second maximum pinched separation 250, 260, are greater than or equal to the first and second maximum cover separation 255, 265, respectively. In this manner, the nested cable assembly 200 includes a nested neutral axis 201 that can be coincident with the first and second neutral axis 211, 221.

In one particular embodiment, the first and second maximum pinched separations 250, 260 are equal to each other, and the first and second maximum cover separations 255, 265 are also equal to each other, and the nested neutral axis 201 is coincident with first and second neutral axis 211, 221, as shown. In one particular embodiment, each of the electrical conductors (for example, 132*a*, 134*a*, and 142*a*, 144*a* as shown in FIGS. 2B-2C) are the same diameter in the first and second electrical cables 210, 220, and the nested neutral axis 201 is coincident with first and second neutral axis 211, 221, as shown. However, in some cases, each of the electrical conductors (for example, 132*a*, 134*a*, and 142*a*, 144*a* as shown in FIGS. 2B-2C) are different diameters in the first and second electrical cables 210, 220, and the nested neutral axis 201 is not coincident with first and second neutral axis 211, 221.

In one particular embodiment, the pinched portions 218, 228, can be individually formed (for example by rolling or pressing within a mold or form) before nesting the first and second electrical cables 210, 220, such that the first and second maximum pinched separation 250, 260, are greater than or equal to the first and second maximum cover separation 255, 265, respectively. In one particular embodiment, the pinched portions 218, 228, can have sufficient separation between adjacent cover portions 216, 226, such that upon nesting and pressing the first and second electrical cables 210, 220 together, the pinched portions 218, 228, deform and mold to the contours of the cover portions 216, 226, such that first and second maximum pinched separation 250, 260, are greater than or equal to the first and second maximum cover separation 255, 265, respectively.

In one particular embodiment, each of the first and second electrical cables 210, 220 can further include any desired number of optional ground wires and/or drain wires 270, 272, 275, disposed at any desired locations along the cable. In some cases, optional ground and/or drain wires 270, 272, 275 can be in electrical contact with the same or different carrier films, such as first carrier films 112, 122 or second carrier films 114, 124. As shown in FIG. 3, optional first ground/drain wire 270 can be in electrical contact with first carrier film 112, 122; optional second ground/drain wire 272 can be in electrical contact with second carrier film 114, 124; and optional third ground/drain wire 275 can be within cover portion 216, 226 and adjacent to an interior surface 273, 274, of either or both of first carrier film 112, 122, or second carrier film 114, 124. It is to be understood that similar optional ground and or drain wires 270, 272, 275, can be included in any of the nested cable assemblies herein described, although they are not specifically shown in all the figures.

Figure 4A:
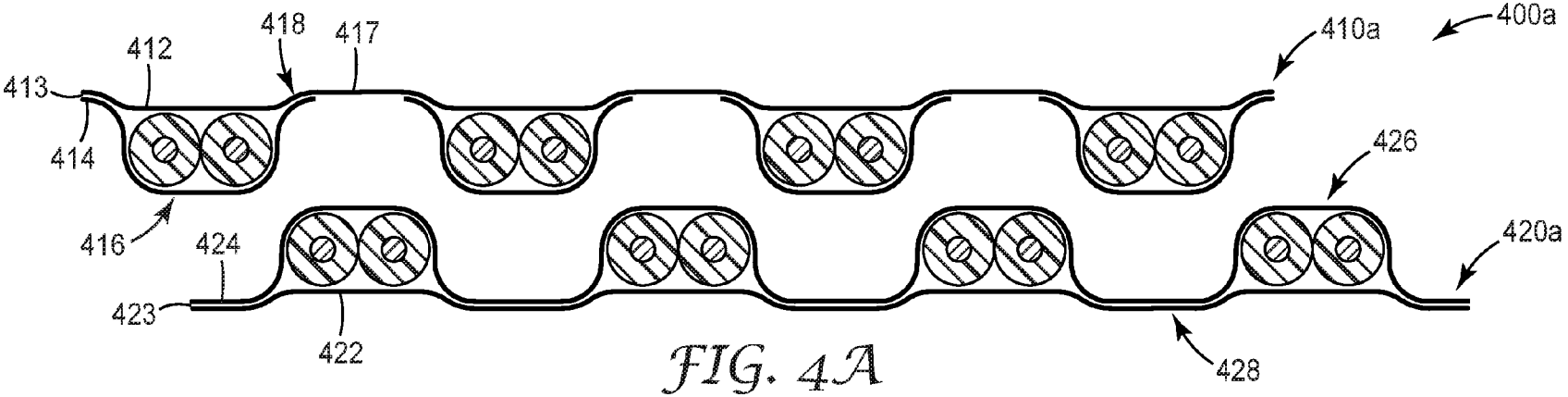
FIGS. 4A-4B shows a schematic cross-sectional view of a nested cable.
Figure 4B:
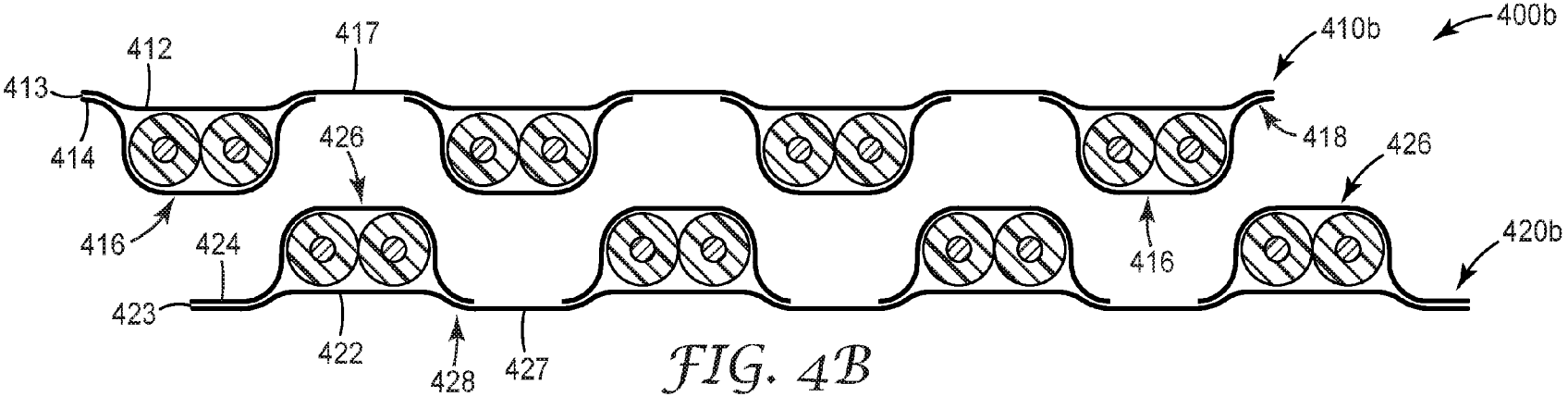

FIGS. 4A-4B show a schematic cross-sectional view of a nested cable assembly 400*a*, 400*b*, according to one aspect of the disclosure. In FIGS. 4A-4B, a lower modulus film enables a reduced stiffness of the nested cable assembly 400*a*, 400*b*, and improved ability to flex upon bending. Each of the elements 410-428 shown in FIG. 4A-4B correspond to like-numbered elements 110-128 shown in FIGS. 2A-2C, which have been described previously, and the contemplated materials and properties of materials likewise correspond. For example, first electrical cable 410 in FIGS. 4A-4B corresponds to first electrical cable 110 in FIG. 2A, and so on.

In FIG. 4A, first electrical cable 410*a* includes cover portions 416 and pinched portions 418 that include first and second carrier films 412, 414 bonded together with adhesive 413. Each of the cover portions 416 and pinched portions 418 that surround a cable assembly (for example, such as those labeled as 130*a*-130*d* in FIG. 2B) are disposed on a first carrier film 417 that connects the cable assemblies and has a lower modulus that either of the first or second carrier films 412, 414. In one particular embodiment, first carrier film 417 can be selected from either an elastic material or an inelastic material.

Second electrical cable 420*a* includes cover portions 426 and pinched portions 428 that include first and second carrier films 422, 424 bonded together with adhesive 423. The nested cable assembly 400*a* is formed by positioning the cover portions 416 of the first electrical cable 410 adjacent the pinched portion 428 of the second electrical cable 420, and the corresponding cover portions 426 of the second electrical cables 420 adjacent the first carrier film 417 that connects the cable assemblies of the first electrical cable 110, as shown in FIG. 4A. The lower modulus of first carrier film 417 permits greater flexibility during bending of the nested cable assembly 400*a*.

In FIG. 4B, first electrical cable 410*b* includes cover portions 416 and pinched portions 418 that include first and second carrier films 412, 414 bonded together with adhesive 413. Each of the cover portions 416 and pinched portions 418 that surround a cable assembly (for example, labeled as 130*a*-130*d* in FIG. 2B) are disposed on a first carrier film 417 that connects the cable assemblies and has a lower modulus that either of the first or second carrier films 412, 414. In one particular embodiment, first carrier film 417 can be selected from either an elastic material or an inelastic material.

Second electrical cable 420*b* includes cover portions 426 and pinched portions 428 that include first and second carrier films 422, 424 bonded together with adhesive 423. Each of the cover portions 426 and pinched portions 428 that surround a cable assembly (for example, labeled as 130*a*-130*d* in FIG. 2B) are disposed on a first carrier film 427 that connects the cable assemblies and has a lower modulus that either of the first or second carrier films 422, 424. In one particular embodiment, first carrier film 427 can be selected from either an elastic material or an inelastic material.

The nested cable assembly 400*b* is formed by positioning the cover portions 416 of the first electrical cable 410 adjacent the a first carrier film 427 that connects the cable assemblies of the second electrical cable 420, and the corresponding cover portions 426 of the second electrical cables 420 adjacent the first carrier film 417 that connects the cable assemblies of the first electrical cable 110, as shown in FIG. 4B. The lower modulus of first carrier film 417, 427 permits greater flexibility during bending of the nested cable assembly 400*b*.

Figure 5A:
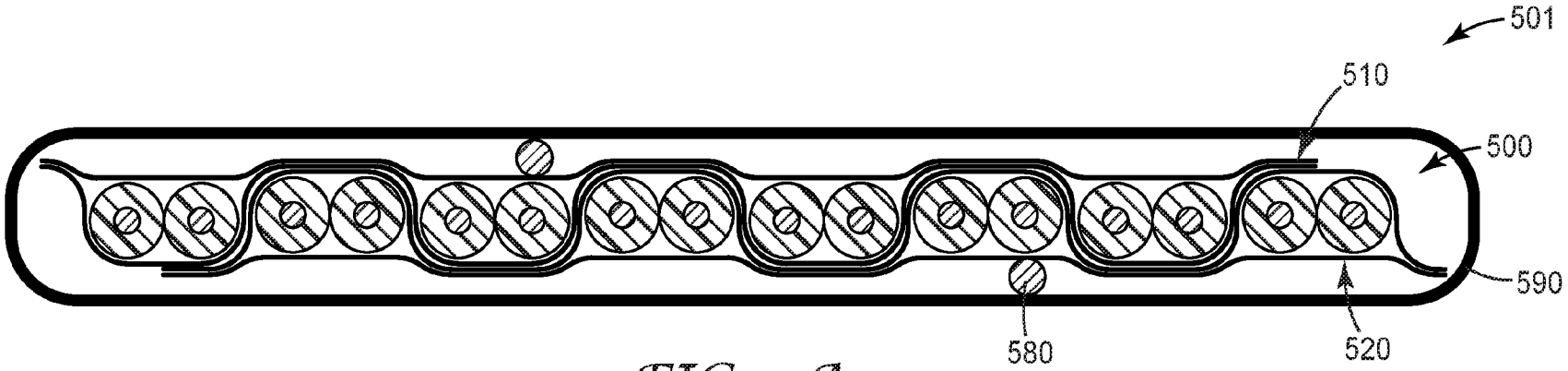
FIGS. 5A-5B shows schematic cross-sectional views of jacketed nested cables.
Figure 5B:
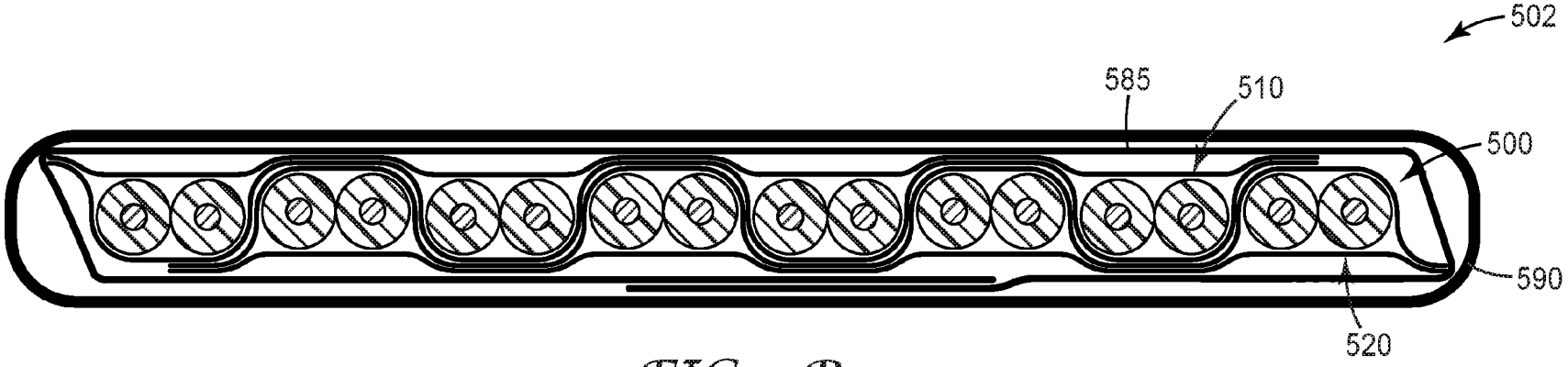

FIGS. 5A-5B shows schematic cross-sectional views of jacketed nested cable assembly 501, 502, according to one aspect of the disclosure. Jacketed nested cable assembly 501 includes a nested cable assembly 500 having a first electrical cable 510 and a second electrical cable 520, as described elsewhere. A jacket 590 surrounds the nested cable assembly 500. Jacket 590 can provide, for example, environmental protection, electrical insulation, and improved robustness of the cable. Optional ground/drain wires 580 can be provided within the jacket 590 to provide additional strength to the cable, and also strain relief at the termination ends of the cable assembly. In some cases, particularly where additional grounding is not needed, optional ground/drain wires 580 can instead be fabricated from a reinforcing dielectric like nylon or another polymer.

Jacketed nested cable assembly 502 includes a nested cable assembly 500 having a first electrical cable 510 and a second electrical cable 520, as described elsewhere. A jacket 590 surrounds the nested cable assembly 500. Jacket 590 can provide environmental protection, electrical insulation, and improved robustness of the cable. Optional conductive shielding 585 can be provided within the jacket 590 to provide additional shielding to the cable assembly. In some cases, particularly where additional shielding is required due to excessive external fields, several layers of conductive shielding 585 can be included within jacket 590. In one particular embodiment, the several layers of conductive shielding 585 can comprise layers of conductive material in a polymeric film, such as described, for example, in U.S. Patent Application No. US2010/0300744 (Romanko et al.). In some cases, each layer of conductive shielding 585 can be in contact with additional optional ground/drain wires (not shown) to provide electrical contact terminated at a chassis ground.

Figure 6A:
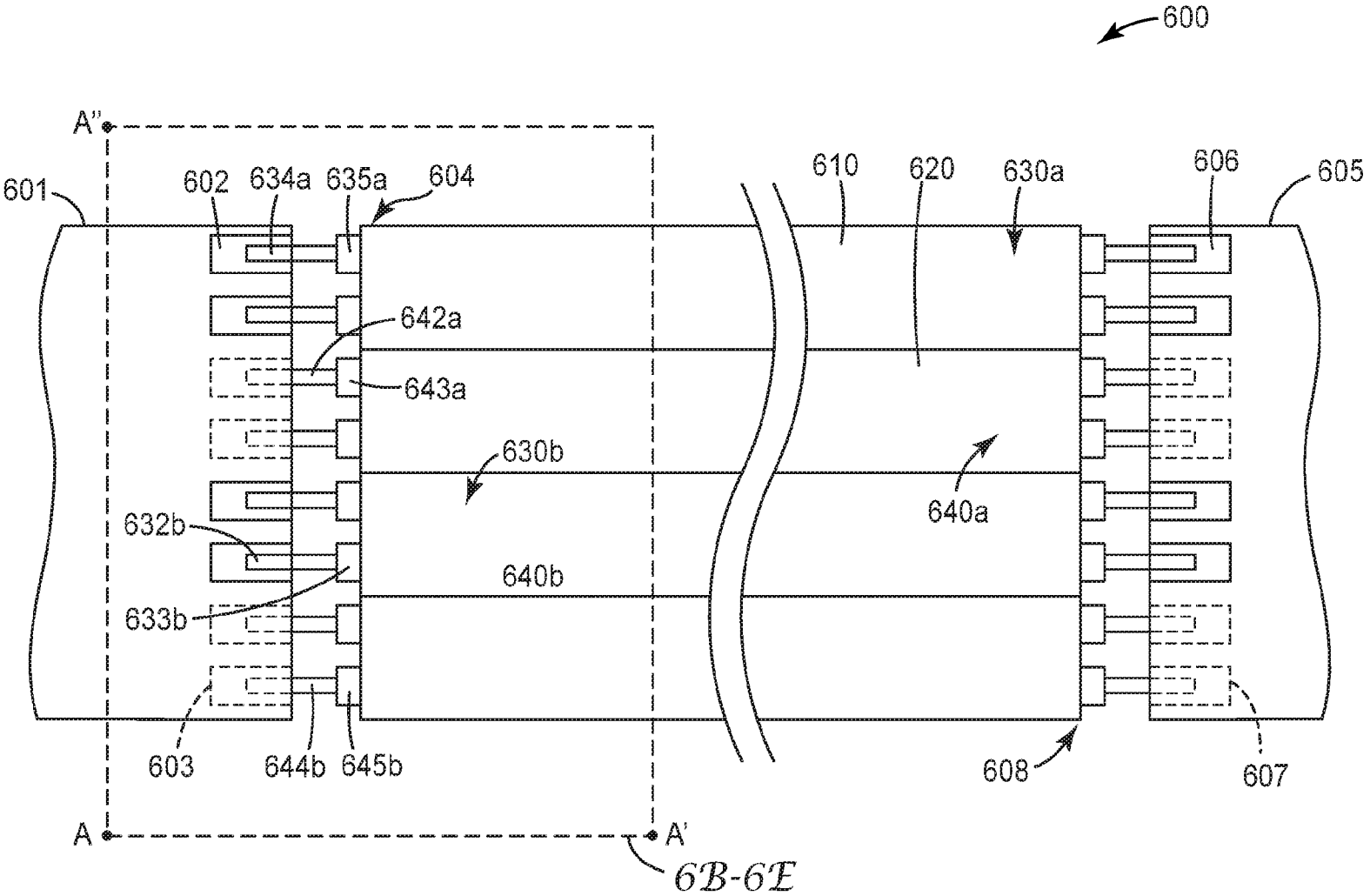
FIG. 6A shows a schematic top view of a terminated nested cable assembly.

FIG. 6A shows a schematic top view of a terminated nested cable assembly 600 according to one aspect of the disclosure. Each of the elements 610-645 shown in FIG. 6A corresponds to like-numbered elements 110-145 shown in FIG. 2B, which have been described previously, and the contemplated materials and properties of materials likewise correspond. For example, first electrical cable 610 in FIG. 6A corresponds to first electrical cable 110 in FIG. 2A, and so on. For clarity, only a few representative elements are shown and described in the following description of FIG. 6A.

In FIG. 6A, terminated nested cable assembly 600 includes nested first and second electrical cables 610, 620, each having a first nested cable end 604 and an opposite second nested cable end 608. Each of the first and the second electrical cables 610, 620, include first and second conductor sets 630*a*, 630*b* and 640*a*, 640*b*, respectively. Each of the first and second conductor sets (630*a*, 630*b*, 640*a*, 640*b*) include conductors (for example, 632*a*, 634*a*, 642*b*, 644*b*) and insulators (for example, 633*a*, 635*a*, 643*b*, 645*b*). The first nested cable end 604 and the second nested cable end 608 of terminated nested cable assembly 600 are disposed proximate first printed circuit board 601 and second printed circuit board 605, respectively, where they are each electrically connected. The electrical connections can be made by any known suitable technique including, for example, crimping, clamping, adhering, soldering, welding, ultrasonically bonding, and the like.

In one particular embodiment, the first nested cable end 604 has electrical conductors (for example, 634*a*, 632*b*) from first electrical cable 610 electrically connected with first side conductor pads 602 of first printed circuit board 601, and electrical conductors (for example, 642*a*, 644*b*) from second electrical cable 620 electrically connected with second side conductor pads 603 of first printed circuit board 601. In some cases, any number of the electrical conductors (for example, 634*a*, 632*a*, 642*a*, 644*b*) from either the first electrical cable 610 or the second electrical cable 620 may be electrically connected with either the first side conductor pads 602, the second side conductor pads 603, or both the first side conductor pads 602 and the second side conductor pads 603, or first printed circuit board 601.

In one particular embodiment, the second nested cable end 608 has electrical conductors (for example, 634*a*, 632*b*) from first electrical cable 610 electrically connected with first side conductor pads 606 of second printed circuit board 605, and electrical conductors (for example, 642*a*, 644*b*) from second electrical cable 620 electrically connected with second side conductor pads 607 of second printed circuit board 605. In some cases, any number of the electrical conductors (for example, 634*a*, 632*a*, 642*a*, 644*b*) from either the first electrical cable 610 or the second electrical cable 620 may be electrically connected with either the first side conductor pads 606, the second side conductor pads 607, or both the first side conductor pads 606 and the second side conductor pads 607 of second printed circuit board 605.

Figure 6B:
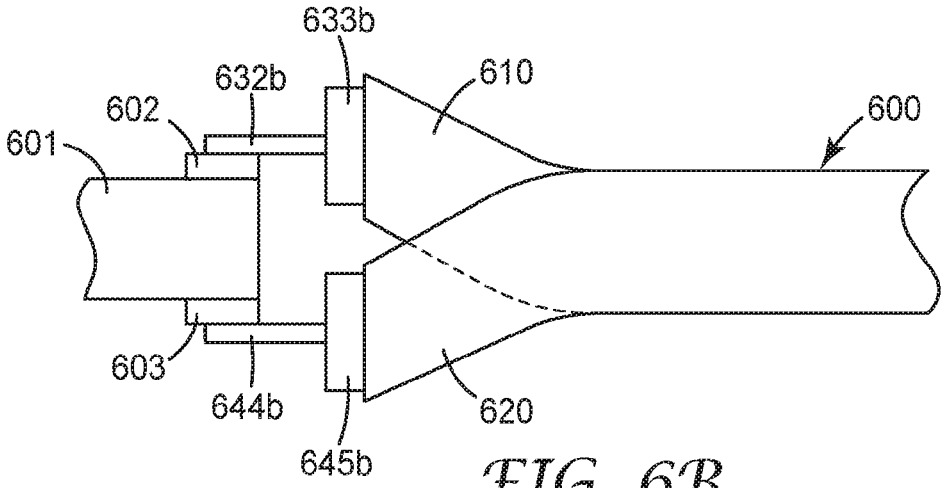
FIGS. 6B-6D show schematic side views of a portion of FIG. 6A.
Figure 6C:
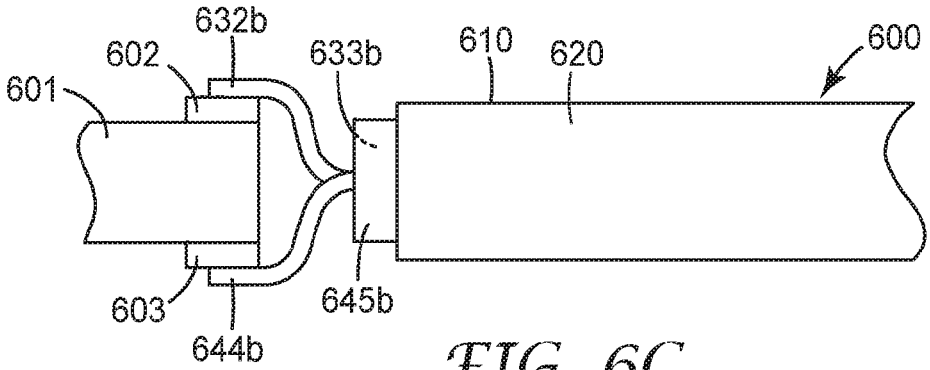
Figure 6D:
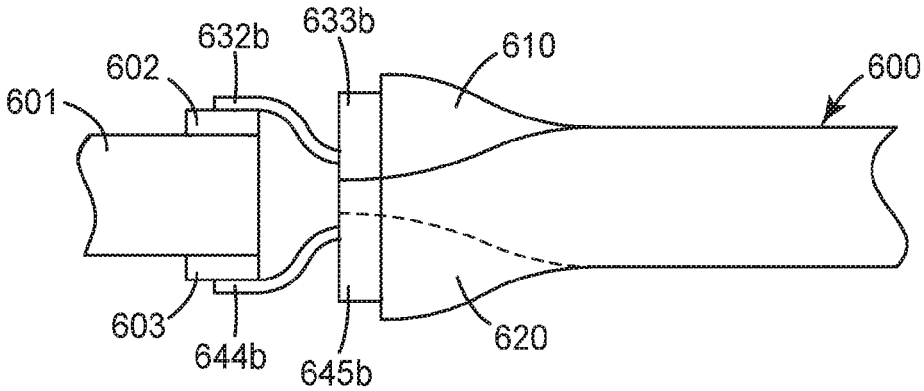

FIGS. 6B-6D show schematic side views through line A-A' of a portion of FIG. 6A in the vicinity of first nested cable end 604 that is designated 6B-6E (that is, the first nested cable end 604). Each of the elements 601-645 shown in FIGS. 6B-6D corresponds to like-numbered elements 601-645 shown in FIG. 6A, which have been described previously, and the contemplated materials and properties of materials likewise correspond. For example, first printed circuit board 601 in FIGS. 6B-6D corresponds to first printed circuit board 601 in FIG. 6A, and so on. For clarity, only a few representative elements are shown and described in the following description of FIGS. 6B-6D.

In one aspect, the embodiments described in FIGS. 6B-6D illustrate the ability of nested cable configuration to provide many customizable termination schemes where the signal wires from one ribbon can be terminated on one side of a paddle card (for example at the near-end termination) and the same side or opposite side of a paddle card at the far end termination. Accomplishing termination on opposite sides using two conventional prior art ribbons that are not staggered or nested as in the present disclosure, may require the ribbons to be twisted and/or flipped to accomplish any arbitrary termination order (termed a "pinout") for a given connection scheme. It is to be understood that for any nested cable described herein, each pair can be terminated to any side of a PCB or paddle card, and also, any single signal wire from any pair (if cables are paired) can be on one side while the other wire of the pair can be routed to the opposite side of the PCB or paddle card. Further, each nested cable can be terminated on the same side of a paddle card, if desired.

Further, it is to be understood that for any nested cable described herein, the conductors can be routed to the opposite side of a PCB or paddle card without un-nesting or using the described slots. Conventional prior art ribbons that are not staggered or nested as in the present disclosure, may require that the conductors have to be long to reach the other side when bent, resulting in the electrical signal becoming compromised by crosstalk and impedance changes. By nesting the cables, the conductors do not have to extend far before termination, and the signal will be in better shape when it arrives. In such cases, the signal integrity can better be maintained if crossing to the other side of a PCB or paddle card is necessary.

In FIG. 6B, first electrical cable 610 and second electrical cable 620 are displaced from the nested positions described elsewhere for terminated nested cable assembly 600, in the vicinity of first printed circuit board 601. In some cases, the cables can be displaced by "un-nesting"—that is, slightly pulling apart from each other as shown, for example, by reversing the assembly of FIG. 3. In some cases, the cables can be displaced by slotting either one or both cables at one end and interweaving the cables, as described, for example, in FIGS. 2A-2C. Each of the electrical conductors 632*b*, 644*b* are affixed to first and second side conductor pads 602, 603, respectively, with minimal bending or stress on the conductors as shown.

In FIG. 6C, first electrical cable 610 and second electrical cable 620 remain in the nested positions of terminated nested cable assembly 600 in the vicinity of first printed circuit board 601. Each of the electrical conductors 632*b*, 644*b* are affixed to first and second side conductor pads 602, 603, respectively, by bending the conductors as shown.

In FIG. 6D, first electrical cable 610 and second electrical cable 620 are displaced slightly from the nested positions described elsewhere for terminated nested cable assembly 600, in the vicinity of first printed circuit board 601. In some cases, the cables can be displaced by "un-nesting"—that is, slightly pulling apart from each other as shown, for example, by reversing the assembly of FIG. 3. In some cases, the cables can be displaced by slotting either one or both cables at one end and interweaving the cables, as described, for example, in FIGS. 2A-2C. Each of the electrical conductors 632*b*, 644*b* are affixed to first and second side conductor pads 602, 603, respectively, with slight bending or stress on the conductors as shown.

Figure 6E:
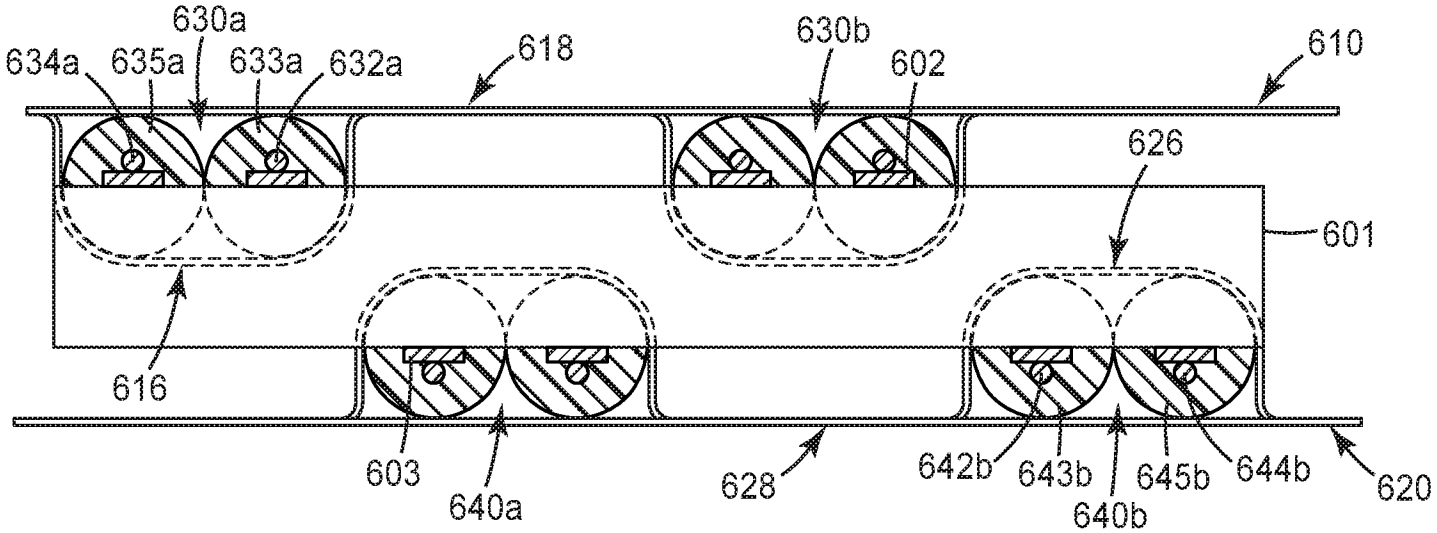
FIG. 6E shows a schematic end view of a portion of FIG. 6A.

FIG. 6E shows a schematic end view through line A-A" of a portion of FIG. 6A in the vicinity of first nested cable end 604 that is designated 6B-6E. Each of the elements 601-645 shown in FIG. 6E corresponds to like-numbered elements 601-645 shown in FIG. 6A, which have been described previously, and the contemplated materials and properties of materials likewise correspond. For example, first printed circuit board 601 in FIG. 6E corresponds to first printed circuit board 601 in FIG. 6A, and so on.

The particular embodiment shown in FIG. 6E corresponds most directly to the side view shown in FIG. 6B or FIG. 6D, where each of the electrical cables have been "un-nested" at least partially in the vicinity of first printed circuit board 601.

Figure 6F:
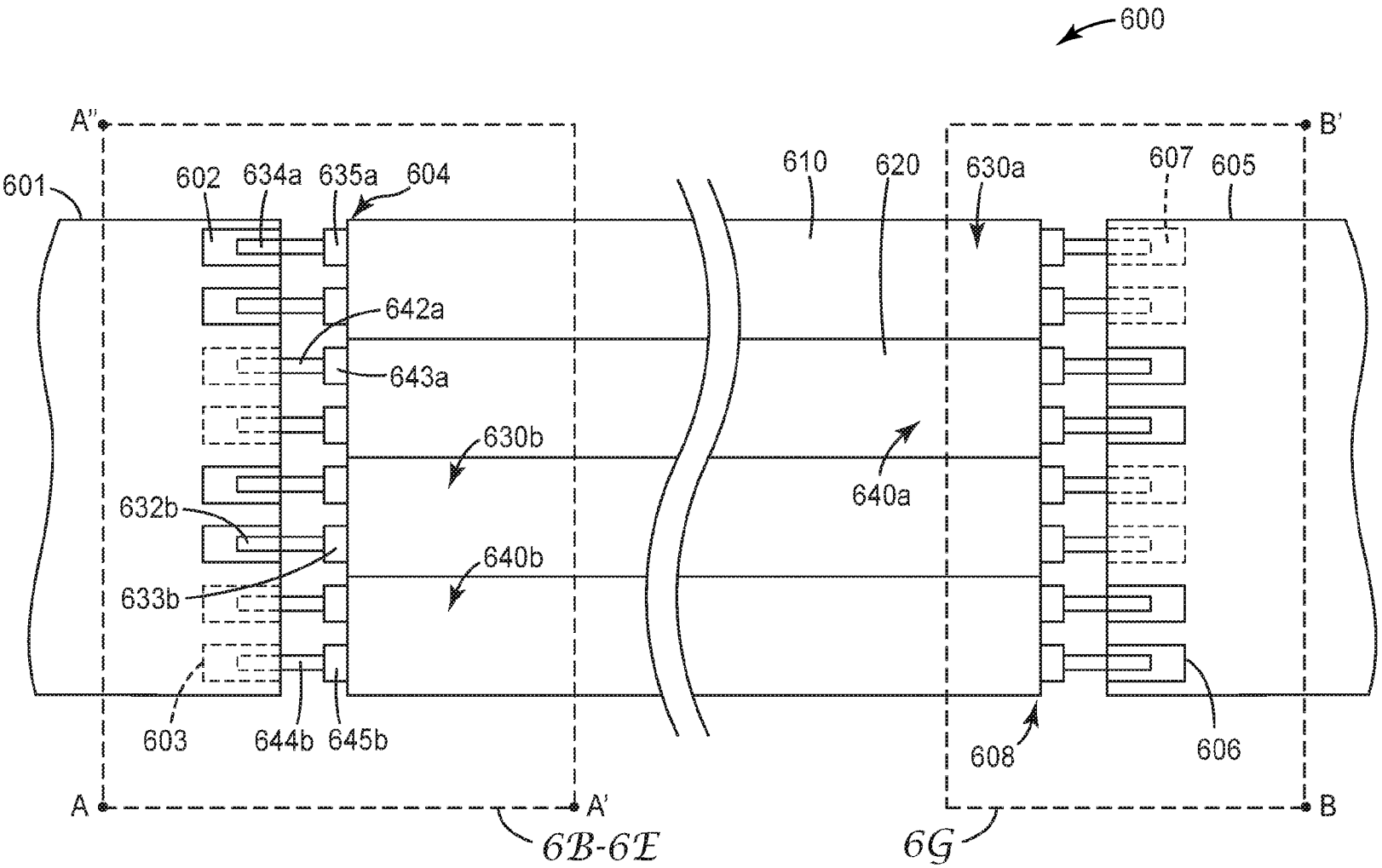
FIG. 6F shows a schematic top view of a terminated nested cable assembly.

FIG. 6F shows a schematic top view of a terminated nested cable assembly 600 according to one aspect of the disclosure. Each of the elements 610-645 shown in FIG. 6F corresponds to like-numbered elements 610-645 shown in FIG. 6A, which have been described previously, and the contemplated materials and properties of materials likewise correspond. FIG. 6F shows one particular embodiment of the disclosure, where the electrical connections of the first nested cable end 604 are attached to the first side of the first printed circuit board, and the electrical connections of the second nested cable end 608 are attached to second side of the second printed circuit board.

In FIG. 6F, terminated nested cable assembly 600 includes nested first and second electrical cables 610, 620, each having a first nested cable end 604 and an opposite second nested cable end 608. Each of the first and the second electrical cables 610, 620, include first and second conductor sets 630*a*, 630*b* and 640*a*, 640*b*, respectively. Each of the first and second conductor sets (630*a*, 630*b*, 640*a*, 640*b*) include conductors (for example, 632*a*, 634*a*, 642*b*, 644*b*) and insulators (for example, 633*a*, 635*a*, 643*b*, 645*b*). The first nested cable end 604 and the second nested cable end 608 of terminated nested cable assembly 600 are disposed proximate first printed circuit board 601 and second printed circuit board 605, respectively, where they are each electrically connected. The electrical connections can be made by any known suitable technique including, for example, crimping, clamping, adhering, soldering, welding, ultrasonically bonding, and the like.

In one particular embodiment, the first nested cable end 604 has electrical conductors (for example, 634*a*, 632*b*) from first electrical cable 610 electrically connected with first side conductor pads 602 of first printed circuit board 601, and electrical conductors (for example, 642*a*, 644*b*) from second electrical cable 620 electrically connected with second side conductor pads 603 of first printed circuit board 601. In some cases, any number of the electrical conductors (for example, 634*a*, 632*a*, 642*a*, 644*b*) from either the first electrical cable 610 or the second electrical cable 620 may be electrically connected with either the first side conductor pads 602, the second side conductor pads 603, or both the first side conductor pads 602 and the second side conductor pads 603, or first printed circuit board 601.

In one particular embodiment, the second nested cable end 608 has electrical conductors (for example, 634*a*, 632*b*) from first electrical cable 610 electrically connected with second side conductor pads 607 of second printed circuit board 605, and electrical conductors (for example, 642*a*, 644*b*) from second electrical cable 620 electrically connected with first side conductor pads 606 of second printed circuit board 605. In some cases, any number of the electrical conductors (for example, 634*a*, 632*a*, 642*a*, 644*b*) from either the first electrical cable 610 or the second electrical cable 620 may be electrically connected with either the first side conductor pads 606, the second side conductor pads 607, or both the first side conductor pads 606 and the second side conductor pads 607 of second printed circuit board 605. FIGS. 6B-6D show schematic side views through line A-A' of a portion of FIG. 6F in the vicinity of first nested cable end 604 that is designated 6B-6E, and FIG. 6E shows a schematic end view through line A-A" of a portion of FIG. 6F in the vicinity of first nested cable end 604 that is designated 6B-6E, both as described previously with reference to FIG. 6A.

Figure 6G:
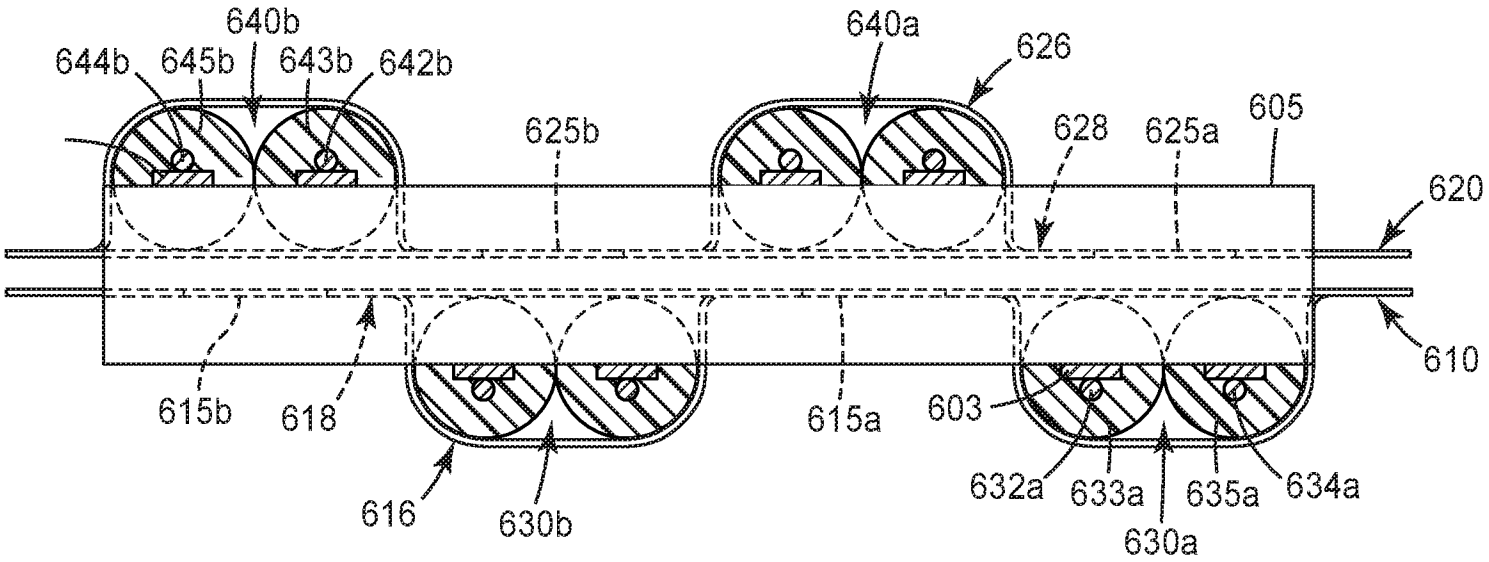
FIG. 6G shows a schematic end view of a portion of FIG. 6F.

FIG. 6G shows a schematic end view through line B-B' of a portion of FIG. 6F in the vicinity of second nested cable end 608 that is designated 6G (that is, including the second nested cable end 608). Each of the elements 601-645 shown in FIG. 6G corresponds to like-numbered elements 601-645 shown in FIG. 6A, which have been described previously, and the contemplated materials and properties of materials likewise correspond.

The particular embodiment shown in FIG. 6G corresponds most directly to the side view shown in FIG. 6B or FIG. 6D, where each of the electrical cables have been displaced by slotting the cables at the second end 608 and interweaving the cables, as described, for example, in FIGS. 2A-2C. At the second nested cable end 608 of the terminated nested cable assembly 600, the first electrical cable 610 and the second electrical cable 620 have been pulled through first slots 615*a*, 615*b*, and second slots 625*a*, 625*b*, respectively. In this particular embodiment, each of the first and second conductor sets 630*a*, 630*b*, are disposed proximate the second side conductor pads 603, and each of the first and second conductor sets 640*a*, 640*b*, are disposed proximate the first side conductor pads 602. Each of the electrical conductors (for example, 632*b*, 644*b*) are affixed to second and first side conductor pads (603, 602, respectively), with minimal bending or stress on the conductors as shown.

Following are a list of embodiments of the present disclosure.

Item 1 is an electrical cable assembly comprising first and second electrical cables, each cable comprising a plurality of conductor sets extending along a length of the cable assembly and being spaced apart from each other along a width of the cable assembly, the first electrical cable comprising at least first and second conductor sets each comprising at least two insulated conductors, each conductor set in the second electrical cable comprising at least one insulated conductor, each conductor set in the first and second electrical cable comprising: first and second carrier films disposed on opposite first and second sides of the electrical cable, the first and second carrier films including cover portions and pinched portions arranged such that, in transverse cross section, the cover portions of the first and second carrier films in combination substantially surround each conductor set, and the pinched portions of the first and second carrier films in combination form pinched portions of the cable on each side of each conductor set; and an adhesive layer bonding the first and second carrier films in the pinched portions of the cable; wherein the first and second electrical cables are arranged such that each conductor set of each cable is disposed within a pinched portion of the other cable, and wherein at least one of the first and second electrical cables includes a slot in the pinched portion of the cable that extends through the cable, the slot having a slot width that is not greater than a width of the pinched portion and a slot length that is less than the length of the cable, the slot being sufficiently wide to allow an insulated conductor of a conductor set of the other cable that is disposed in the pinched portion to at least partially penetrate the slot.

Item 2 is the electrical cable assembly of item 1, further comprising at least one flexible conductor wrapped around the width of the cable assembly and extending along the length of the cable assembly.

Item 3 is the electrical cable assembly of item 2, wherein the at least one flexible conductor comprises a metalized polymer film.

Item 4 is the electrical cable assembly of item 3, wherein the metalized polymer film comprises at least two metalized layers.

Item 5 is the electrical cable assembly of item 1 to item 4, further comprising a jacket at least partially surrounding the electrical cable assembly.

Item 6 is the electrical cable assembly of item 1 to item 5, wherein each conductor set in the second electrical cable comprises at least two insulated conductors.

Item 7 is the electrical cable assembly of item 1 to item 6, wherein the first electrical cable and the second electrical cable each comprise at least four conductor sets, each of conductor set comprising two insulated conductors.

Item 8 is the electrical cable assembly of item 1 to item 7, wherein each pinched portion in the first and second electrical cables that houses a conductor set therein includes a slot, at least a portion of at least some of the insulated conductors of the housed conductor sets being guided through the corresponding slots to the opposite side of the pinched portions.

Item 9 is an electrical cable assembly comprising a plurality of conductor sets extending along a length of the cable and being spaced apart from each other along a width of the cable, the plurality of the conductor sets comprising at least one conductor set comprising at least two insulated conductors, each conductor set comprising: first and second shielding films disposed on opposite first and second sides of the electrical cable, the first and second shielding films including cover portions and pinched portions arranged such that, in transverse cross section, the cover portions of the first and second carrier films in combination substantially surround each conductor set, and the pinched portions of the first and second films in combination form pinched portions of the cable on each side of each conductor set; and an adhesive layer bonding the first and second shielding films in the pinched portions of the cable; wherein a maximum first separation of a pinched portion of the electrical cable from a plane intersecting each conductor is greater than a maximum second separation of the cover portions on either side of the pinched portion, from the plane intersecting each conductor.

Item 10 is an electrical cable assembly comprising a pair of intermeshing electrical cables, each electrical cable according to item 9, wherein the pair of electrical cables are arranged such that each conductor set of each cable is disposed within a pinched portion of the other cable.

Item 11 is the electrical cable assembly of item 10, wherein the conductors comprise a neutral plane.

Item 12 is the electrical cable assembly of item 10 or item 11, further comprising at least one flexible conductor wrapped around the width of the cable assembly and extending along the length of the cable assembly.

Item 13 is the electrical cable assembly of item 12, wherein the at least one flexible conductor comprises a metalized polymer film.

Item 14 is the electrical cable assembly of item 13, wherein the metalized polymer film comprises at least two metalized layers.

Item 15 is the electrical cable assembly of claim 10 to claim 14, further comprising a jacket at least partially surrounding the electrical cable assembly.

Item 16 is an electrical cable assembly comprising a plurality of conductor sets extending along a length of the cable and being spaced apart from each other along a width of the cable, each conductor set comprising: at least one insulated conductor; first and second carrier films disposed on opposite first and second sides of the electrical cable, the first and second carrier films including cover portions and pinched portions arranged such that, in transverse cross section, the cover portions of the first and second carrier films in combination substantially surround each conductor set, and the pinched portions of the first and second carrier films in combination form pinched portions of the cable on each side of each conductor set; an adhesive layer bonding the first and second carrier films in the pinched portions of the cable; and a first carrier film affixed to each first carrier film and extending between adjacent conductor sets; wherein the first carrier film has a smaller modulus than the first or second carrier films.

Item 17 is an electrical cable assembly comprising a pair of intermeshing electrical cables, each electrical cable according to item 16, wherein the pair of electrical cables are arranged such that each conductor set of each cable is disposed between adjacent cover portions of the other cable.

Item 18 is the electrical cable assembly of item 17, wherein the conductors comprise a neutral plane.

Item 19 is the electrical cable assembly of item 17 or item 18, further comprising at least one flexible conductor wrapped around the width of the cable assembly and extending along the length of the cable assembly.

Item 20 is the electrical cable assembly of item 19, wherein the at least one flexible conductor comprises a metalized polymer film.

Item 21 is the electrical cable assembly of item 20, wherein the metalized polymer film comprises at least two metalized layers.

Item 22 is the electrical cable assembly of item 17 to item 21, further comprising a jacket at least partially surrounding the electrical cable assembly.

Item 23 is an electrical cable assembly comprising a first plurality of conductor sets extending along a length of the cable and being spaced apart from each other along a width of the cable, and a second plurality of drain wires extending along the length of the cable, each conductor set comprising: at least one insulated conductor; first and second shielding films disposed on opposite first and second sides of the electrical cable, the first and second shielding films including cover portions and pinched portions arranged such that, in transverse cross section, the cover portions of the first and second shielding films in combination substantially surround each conductor set, and the pinched portions of the first and second shielding films in combination form pinched portions of the cable on each side of each conductor set; and an adhesive layer bonding the first and second shielding films in the pinched portions of the cable; wherein, when the cable is laid flat, the insulated conductors define a first neutral plane, the cable without the second plurality of drain wires defines a second neutral plane that is not coincident with the first neutral plane, and the cable with the second plurality of drain wires defines a third neutral plane that is coincident with the first neutral plane.

Item 24 is an electrical cable assembly comprising a pair of intermeshing electrical cables, each electrical cable according to item 23, wherein the pair of electrical cables are arranged such that each conductor set of each cable is disposed within a portion of the other cable.

Item 25 is the electrical cable assembly of item 23 or item 24, further comprising at least one flexible conductor wrapped around the width of the cable assembly and extending along the length of the cable assembly.

Item 26 is the electrical cable assembly of item 25, wherein the at least one flexible conductor comprises a metalized polymer film.

Item 27 is the electrical cable assembly of item 26, wherein the metalized polymer film comprises at least two metalized layers.

Item 28 is the electrical cable assembly of item 23 to item 27, further comprising a jacket at least partially surrounding the electrical cable assembly.

Item 29 is the electrical cable assembly of item 1 to item 28, wherein at least one insulated conductor is electrically connected to a conductor pad on a circuit board.

Unless otherwise indicated, all numbers expressing feature sizes, amounts, and physical properties used in the specification and claims are to be understood as being modified by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

All references and publications cited herein are expressly incorporated herein by reference in their entirety into this disclosure, except to the extent they may directly contradict this disclosure. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents

What is claimed is:

1. A first electrical cable comprising:

a plurality of conductor sets extending along a length of the cable assembly and spaced apart from each other along a width of the cable, each conductor set comprising at least one insulated conductor and substantially surrounded by an electrically conductive shield; and first and second carrier films disposed on opposite first and second sides of the first electrical cable, the first and second carrier films including cover portions and pinched portions arranged such that the cover portions of the first and second carrier films in combination substantially surround each conductor set and the pinched portions of the first and second carrier films in combination form pinched portions of the cable on each side of the plurality of conductor sets, wherein, when the cable is laid flat, a width of at least one pinched portion is greater than a diameter of an insulated conductor of a conductor set, and wherein the at least one pinched portion comprises a slot therein that extends through the cable, the slot having a slot width that is not greater than the width of the at least one pinched portion and a slot length that is less than the length of the cable, the slot being sufficiently wide to allow an insulated conductor of a conductor set disposed in the at least one pinched portion to at least partially penetrate the slot.

2. The first electrical cable of claim 1, wherein the electrically conductive shield comprises one or more metalized polymer films.

3. The first electrical cable of claim 1 further comprising a jacket surrounding the first electrical cable.

4. An electrical cable assembly, comprising the first electrical cable of claim 1 and a second electrical cable comprising a plurality of insulated conductors, such that at least one insulated conductor of the second electrical cable is disposed in the at least one pinched portion of the first electrical cable.

5. The first electrical cable of claim 1, wherein a maximum first separation of a pinched portion of the first electrical cable from a first plane intersecting each insulated conductor in the plurality of conductor sets is greater than a maximum second separation of the cover portions on either side of the pinched portion, from the first plane.

6. The first electrical cable of claim 1 further comprising a plurality of drain wires extending along the length of the cable.

7. The first electrical cable of claim 6, wherein, when the first electrical cable is laid flat, the insulated conductors define a first neutral plane, the cable without the plurality of drain wires defines a second neutral plane that is not coincident with the first neutral plane, and the cable with the plurality of drain wires defines a third neutral plane that is coincident with the first neutral plane.

8. The first electrical cable of claim 1, wherein at least one conductor set further comprises a drain wire adjacent the at least one insulated conductor of the at least one conductor set.

9. The first electrical cable of claim 8, wherein the drain wire contacts the electrically conductive shield that substantially surrounds the at least one conductor set.

* * * * *